US010132106B2

(12) United States Patent
Rosales

(10) Patent No.: US 10,132,106 B2
(45) Date of Patent: Nov. 20, 2018

(54) MOTOR VEHICLE LOCK ARRANGEMENT

(71) Applicant: Brose Schliesssysteme GmbH & Co. KG, Wuppertal (DE)

(72) Inventor: David Rosales, Rochester Hills, MI (US)

(73) Assignee: Brose Schliesssysteme GmbH & Co. Kommanditgesellschaft, Wuppertal (DE)

( * ) Notice: Subject to any disclaimer, the term of this patent is extended or adjusted under 35 U.S.C. 154(b) by 686 days.

(21) Appl. No.: 14/418,382

(22) PCT Filed: Jul. 26, 2013

(86) PCT No.: PCT/EP2013/065828
§ 371 (c)(1),
(2) Date: Jul. 17, 2015

(87) PCT Pub. No.: WO2014/019960
PCT Pub. Date: Feb. 6, 2014

(65) Prior Publication Data

US 2016/0024819 A1 Jan. 28, 2016

(30) Foreign Application Priority Data

Jul. 31, 2012 (DE) ..... 20 2012 007 312 U

(51) Int. Cl.
*E05B 77/06* (2014.01)
*E05B 15/04* (2006.01)
(Continued)

(52) U.S. Cl.
CPC ..... *E05B 77/06* (2013.01); *E05B 15/04* (2013.01); *E05B 77/12* (2013.01); *E05B 77/54* (2013.01); *E05C 3/16* (2013.01); *E05C 3/22* (2013.01)

(58) Field of Classification Search
CPC ..... E05B 81/14; E05B 85/26; E05B 77/06; E05B 81/90; E05B 77/12; E05B 81/16;
(Continued)

(56) References Cited

U.S. PATENT DOCUMENTS 6,520,549 B1 * 2/2003 Kalsi ..... E05B 81/14 292/201
6,601,883 B1 * 8/2003 Kalsi ..... E05B 81/14 292/201
(Continued)

FOREIGN PATENT DOCUMENTS

DE 202008012949 4/2010
DE 202009009061 1/2011
(Continued)

OTHER PUBLICATIONS

"International Search Report and Written Opinion," for PCT/EP2013/065828 related to U.S. Appl. No. 14/418,382, dated Jan. 7, 2015 (9 pages) [English Translation].
"Search Report," for German Patent Application No. 202012007315.5 related to U.S. Appl. No. 14/418,382, dated Jun. 10, 2013 (4 pages).

*Primary Examiner* — Mark A Williams
(74) *Attorney, Agent, or Firm* — Pauly, DeVries Smith & Deffner LLC

(57) ABSTRACT

A motor vehicle lock arrangement having a motor vehicle lock, wherein the motor vehicle lock has the locking elements of lock latch and pawl, wherein the lock latch is0 adjustable into an open position, into a main locked position and optionally into a pre-locked position, wherein the pawl is adjustable into a lowered position in which it retains the lock latch in a locked position, and into a raised position in which it is disengaged from the lock latch, wherein provision is made of an actuating lever for raising the pawl, wherein a switchable clutch arrangement is arranged between the actuating lever and the pawl, via which clutch arrangement a drive connection between the actuating lever
(Continued)

and the pawl is establishable in the engaged state, and in the disengaged state the drive connection between the actuating lever and the pawl is severable.

20 Claims, 6 Drawing Sheets

(51) Int. Cl.

| | |
|---|---|
| ***E05B 77/12*** | (2014.01) |
| ***E05B 77/54*** | (2014.01) |
| ***E05C 3/16*** | (2006.01) |
| ***E05C 3/22*** | (2006.01) |

(58) Field of Classification Search
CPC .. E05B 2047/0026; E05B 77/54; E05B 81/46; Y10T 292/0908; Y10S 292/23; Y10S 292/65
See application file for complete search history.

(56) References Cited

U.S. PATENT DOCUMENTS

| | | | | |
|---|---|---|---|---|
| 8,764,077 | B2 | 7/2014 | Takagi et al. | |
| 2003/0094818 | A1* | 5/2003 | Tomaszewski | E05B 77/26 292/195 |
| 2011/0181052 | A1 | 7/2011 | Brose et al. | |

FOREIGN PATENT DOCUMENTS

| | | |
|---|---|---|
| DE | 202009017667 | 5/2011 |
| DE | 202010011805 | 1/2012 |
| DE | 202010015103 | 3/2012 |
| DE | 102010049393 | 4/2012 |
| DE | 202012007312 | 11/2013 |
| EP | 1518983 | 3/2005 |
| WO | 2009036419 | 3/2009 |

* cited by examiner

MOTOR VEHICLE LOCK ARRANGEMENT

CROSS-REFERENCE TO RELATED APPLICATIONS

This application is a national stage application under 35 U.S.C. 371 of Inter-national Patent Application Serial No. PCT/EP2013/065828, entitled "Kraftfahrzeugschlossanordnung," filed Jul. 26, 2013, which claims priority from German Patent Application No. DE 20 2012 007 312.5, filed Jul. 31, 2012, the disclosures each of which are incorporated herein by reference.

FIELD OF THE TECHNOLOGY

The invention relates to a motor vehicle lock arrangement and to a door handle.

BACKGROUND

The motor vehicle lock arrangement in question is equipped in each case with a motor vehicle lock. Generally, the motor vehicle lock arrangement is also equipped with a door handle, in particular with an interior door handle and/or exterior door handle, in order to be able to open the motor vehicle lock via corresponding user actuation. The expression "motor vehicle lock" should be interpreted broadly in the present case. It includes all types of door locks, bonnet locks or flap locks. In the present case, the motor vehicle lock assigned to a door of a motor vehicle is in the foreground. This should not be understood in a limiting manner.

The crash safety of the motor vehicle lock arrangement in question is increasingly important today. Here, this involves ensuring that the doors of the motor vehicle do not spring open as a result of the high crash accelerations that occur in the event of a crash. A side impact can for example result in an exterior door handle "standing still" on account of its mass inertia, this resulting overall in a relative movement between the exterior door handle and a motor vehicle door. The result is an actuation operation that takes place automatically as a result of the crash accelerations and is of course undesired.

The known motor vehicle lock arrangement (DE 20 2009 017 667 U1), on which the invention is based, is equipped with a motor vehicle lock which has the conventional locking elements of lock latch and pawl, wherein the pawl can be raised in a likewise conventional manner by means of an actuating lever. In this case, a switchable clutch arrangement is generally arranged between the actuating lever and the pawl, via which clutch arrangement, depending on the lock state of the motor vehicle lock, a drive connection between the actuating lever and the pawl is establishable or severable.

In order to ensure high crash safety, provision is made in the known motor vehicle lock arrangement of a crash element that is arranged separately from the actuating lever and blocks the actuating lever in the event of a crash. This ensures that automatic actuation, caused by the crash accelerations, of the actuating lever and thus undesired raising of the pawl do not take place. However, the blocking action always has to be preceded by an acceleration of the crash element into a blocking position, with the result that the crash element does not respond optimally for some crash accelerations. Furthermore, generally high blocking forces should be applied during the crash-related blocking of the actuating lever, this being associated with high loading of the components involved and a corresponding risk of failure.

The invention is based on the problem of configuring and developing the known motor vehicle lock arrangement such that the crash safety with regard to undesired, crash-related raising of the pawl is increased.

SUMMARY

Embodiments of a motor vehicle lock arrangement as described herein address the above problem.

What is essential is that the actuating lever interacts in a very particular manner with the clutch arrangement between the actuating lever and the pawl, specifically such that, when adjusted into its unactuated state, the actuating lever disengages the engaged clutch arrangement and leaves the disengaged clutch arrangement in the disengaged state and, during its unactuated state, bars engagement of the clutch arrangement and enables this only in the course of its actuation. Ultimately, this interaction between the actuating lever and clutch arrangement ensures that the clutch arrangement is always disengaged when the actuating lever is unactuated.

What is interesting in the solution according to the proposal is the fact that the engagement of the clutch arrangement takes a certain amount of time, in particular on account of inertia, and given a suitable design, this can result in a crash-related and correspondingly rapid actuation of the actuating lever executing an idle stroke in the absence of timely engagement of the clutch arrangement. With the solution according to the proposal, given a suitable design, the crash safety is particularly high in that, in the event of a crash, no acceleration of crash elements or the like is necessary in order to convert crash-related actuation of the actuating lever into an idle stroke. Rather, it is proposed that the components which ensure the disengaged state of the clutch arrangement in the event of a crash remain as far as possible in their respective position on account of inertia in the event of such a crash. It could also be said that the motor vehicle lock according to the proposal is already crash-safe with the actuating lever unactuated.

Several embodiments include design variants which ensure that the actuating lever can always execute an idle stroke as a result of crash-related accelerations.

In an embodiment, the clutch arrangement is a constituent part of a lock mechanism which is lockable and unlockable in a conventional manner. These are generally stationary states which can be set via a central locking lever.

Various embodiments include advantageous variants for realizing the interaction between the actuating lever and the clutch arrangement. In some embodiments, use is made for this purpose of a transmission lever by way of which a predetermined transmission behaviour can be set easily such that the clutch arrangement can be released in a very first actuating part of the actuating movement. In an embodiment, the transmission lever is configured in one variant in the manner of a leg spring.

In an embodiment, the coupling element of the coupling arrangement is a wire or strip that is bendable in a spring-elastic manner and is bendable between the engagement position and the disengagement position. The clutch arrangement can scarcely be realized more easily.

The motor vehicle lock of the motor vehicle lock arrangement is described herein. All of the variants explained here with the associated advantages with respect to the motor vehicle lock arrangement are applicable to the motor vehicle lock.

A door handle for raising the pawl of a motor vehicle lock is described herein. In the mounted state, such a door handle is coupled to the motor vehicle lock such as via a Bowden cable.

According to the proposal, provision is made of an actuating lever of the door handle for raising the pawl, wherein a switchable clutch arrangement of the door handle is arranged between the actuating lever and the pawl, that is to say in the drive train between the actuating lever and the pawl, via which clutch arrangement a drive connection between the actuating lever and the pawl is establishable in the engaged state, and in the disengaged state the drive connection between the actuating lever and the pawl is severable.

What is essential according to this further teaching is that the actuating lever interacts with the clutch arrangement such that, when adjusted into its unactuated state, the actuating lever disengages the engaged clutch arrangement and leaves the disengaged clutch arrangement in the disengaged state and, during its unactuated state, bars engagement of the clutch arrangement and enables this only in the course of its actuation.

In principle, the further teaching corresponds to the functional principle of the motor vehicle lock arrangement according to the proposal, wherein in each case the actuating lever and optionally also the clutch arrangement are accommodated in the door handle. In this respect, reference may be made to all statements given with respect to the motor vehicle lock arrangement according to the proposal.

In an embodiment, a motor vehicle lock arrangement having a motor vehicle lock, wherein the motor vehicle lock has the locking elements of lock latch and pawl, wherein the lock latch is adjustable into an open position, into a main locked position and optionally into a pre-locked position, wherein the pawl is adjustable into a lowered position in which it retains the lock latch in a locked position, and into a raised position in which it is disengaged from the lock latch, wherein provision is made of an actuating lever for raising the pawl, wherein a switchable clutch arrangement is arranged between the actuating lever and the pawl, via which clutch arrangement a drive connection between the actuating lever and the pawl is establishable in the engaged state, and in the disengaged state the drive connection between the actuating lever and the pawl is severable, wherein the actuating lever interacts with the clutch arrangement such that, when adjusted into its unactuated state, the actuating lever disengages the engaged clutch arrangement and leaves the disengaged clutch arrangement in the disengaged state and, during its unactuated state, bars engagement of the clutch arrangement and enables this only in the course of its actuation.

In an embodiment, in the course of the actuation of the actuating lever, the clutch arrangement is engageable, in particular in a spring-driven manner, such that the pawl is raisable during normal operation by in particular continuing actuation of the actuating lever.

In an embodiment, the arrangement is realized such that when the actuating lever is actuated at an actuating speed which is greater than a predetermined limit speed, in particular as a result of crash accelerations that occur in the event of a crash, the actuating lever executes an idle stroke on account of the engagement, delayed in particular on account of inertia, of the clutch arrangement.

In an embodiment, the actuation of the actuating lever comprises a releasing stroke which is associated with the releasing of the clutch arrangement for engagement, and an activating stroke which is associated, with the clutch arrangement engaged, with the raising of the pawl, such as the activating stroke in particular immediately follows the releasing stroke.

In an embodiment, when the actuating lever is actuated at an actuating speed which is greater than a predetermined limit speed, in particular as a result of crash accelerations that occur in the event of a crash, the time required to execute the releasing stroke is less than the time required, in particular on account of inertia, for engagement, and so the actuating lever executes an idle stroke.

In an embodiment, the clutch arrangement is a constituent part of a lock mechanism which can be brought into at least one locking state in which the clutch arrangement is disengaged, and at least one unlocking state in which the clutch arrangement is engaged, such as the lock mechanism has a central locking lever which can be brought into a locking position and into an unlocking position and which, in its unlocking position, disengages the clutch arrangement, such as, in its unlocking position, the central locking lever releases the in particular spring-driven engagement of the clutch arrangement.

In an embodiment, the actuating lever interacts with the clutch arrangement via a transmission arrangement, such as the transmission arrangement is configured as a step-up arrangement such that a movement input on the actuating-lever side is converted into a larger output movement.

In an embodiment, the actuating lever is coupled to the clutch arrangement via a pivotable transmission lever, such as the transmission lever is articulated in a pivotable manner on the actuating lever.

In an embodiment, provision is made of a stop with which the transmission lever comes into engagement when the actuating lever is adjusted into its unactuated state, and in the process disengages the clutch arrangement and bars engagement of the clutch arrangement.

In an embodiment, the transmission lever has a first, stop-side lever arm and a second, clutch-side lever arm, such as, with the actuating lever unactuated, the effective stop-side lever arm is shorter than the effective clutch-side lever arm, such as the two lever arms extend in different directions from the transmission lever axis.

In an embodiment, the transmission lever is formed from a wire or strip that is bendable in a spring-elastic manner, such as the transmission lever is configured in the manner of a leg spring, wherein the one spring leg provides a stop-side lever arm and the other spring leg provides a clutch-side lever arm.

In an embodiment, the clutch arrangement has an adjustable clutch element which is adjustable into an engagement position corresponding to the engaged state and into a disengagement position corresponding to the disengaged state.

In an embodiment, the clutch element is configured as a wire or strip that is bendable in a spring-elastic manner and is bendable between the engagement position and the disengagement position, such as the clutch element is prestressed into the engagement position in particular as a result of its own spring elasticity.

In an embodiment, provision is made of a door handle, in particular an exterior door handle, and in that the actuating lever, and in some embodiments also the clutch arrangement, is or are a constituent part or parts of the door handle and/or is or are accommodated in the door handle, such as the door handle is coupled to the motor vehicle lock via a force transmission element, in particular via a Bowden cable.

In an embodiment, a motor vehicle lock having the locking elements of lock latch and pawl, wherein the lock latch is adjustable into an open position, into a main locked position and optionally into a pre-locked position, wherein the pawl is adjustable into a lowered position in which it retains the lock latch in a locked position, and into a raised position in which it is disengaged from the lock latch, wherein provision is made of an actuating lever for raising the pawl, wherein a switchable clutch arrangement is arranged between the actuating lever and the pawl, via which clutch arrangement a drive connection between the actuating lever and the pawl is establishable in the engaged state, and in the disengaged state the drive connection between the actuating lever and the pawl is severable, wherein the actuating lever interacts with the clutch arrangement such that, when adjusted into its unactuated state, the actuating lever disengages the engaged clutch arrangement and leaves the disengaged clutch arrangement in the disengaged state and, during its unactuated state, bars engagement of the clutch arrangement and enables this only in the course of its actuation, is provided.

In an embodiment, a door handle for raising the pawl of a motor vehicle lock, wherein, in addition to the pawl, the motor vehicle lock has a lock latch, wherein the lock latch is adjustable into an open position, into a main locked position and optionally into a pre-locked position, wherein the pawl is adjustable into a lowered position in which it retains the lock latch in a locked position, and into a raised position in which it is disengaged from the lock latch, wherein provision is made of an actuating lever of the door handle for raising the pawl, wherein a switchable clutch arrangement of the door handle is arranged between the actuating lever and the pawl, via which clutch arrangement a drive connection between the actuating lever and the pawl is establishable in the engaged state, and in the disengaged state the drive connection between the actuating lever and the pawl is severable, wherein the actuating lever interacts with the clutch arrangement such that, when adjusted into its unactuated state, the actuating lever disengages the engaged clutch arrangement and leaves the disengaged clutch arrangement in the disengaged state and, during its unactuated state, bars engagement of the clutch arrangement and enables this only in the course of its actuation.

BRIEF DESCRIPTION OF THE DRAWINGS

The invention is explained in more detail in the following text with reference to a drawing that illustrates merely exemplary embodiments. In the drawing

DETAILED DESCRIPTION

Figure 1:
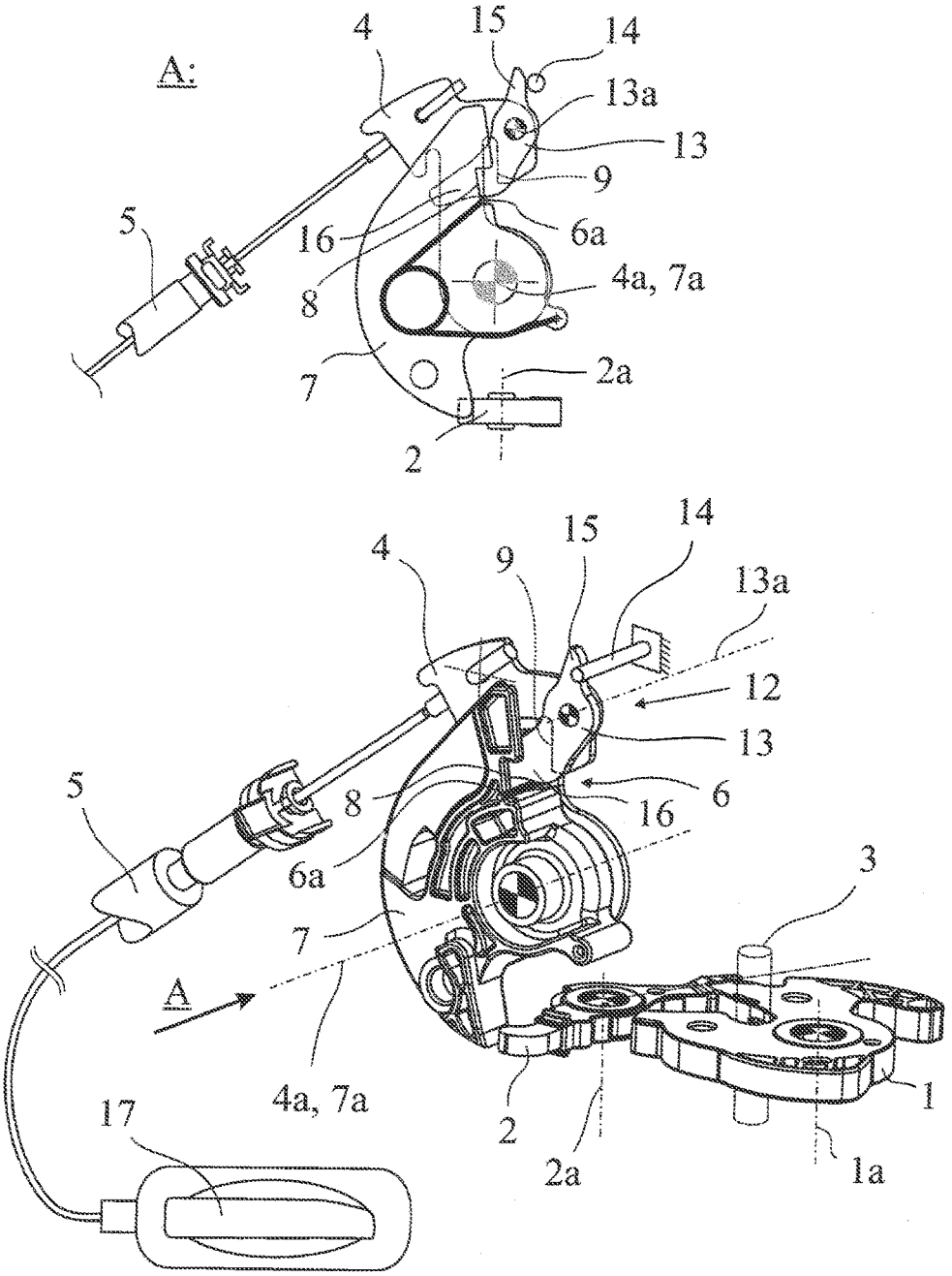
FIG. 1 shows the components, essential for the solution according to the proposal, of a motor vehicle lock arrangement according to the proposal during normal operation with the actuating lever unactuated.

The motor vehicle lock arrangement according to the proposal is equipped with a motor vehicle lock. The expression "motor vehicle lock" includes, as already discussed in the introductory part of the description, all types of door locks, bonnet locks or flap locks.

The motor vehicle lock illustrated in the drawing is shown only with the components which are essential for explaining the teaching according to the proposal.

The motor vehicle lock is equipped with the conventional locking elements of lock latch 1 and pawl 2, wherein the lock latch 1 is adjustable into an open position, a main locked position illustrated in the drawing, and optionally into a pre-locked position. The lock latch 1 interacts in a likewise conventional manner with a striker 3 (merely indicated in FIG. 1) or the like which can be arranged in a manner fixed to the body.

The pawl 2 can be brought into the lowered position illustrated in FIGS. 1, 2 and 4 to 6, in which it retains the lock latch 1 in the particular locked position. Here, the pawl 2 is prestressed into its lowered position and can be brought into a raised position in which it is disengaged from the lock latch (FIG. 3) such that the lock latch 1 can pivot into the open position in the anticlockwise direction in FIG. 3.

In order to raise the pawl 2, provision is made of an actuating lever 4. In the exemplary embodiment that is illustrated, the actuating lever 4 is an external actuating lever which is coupled via a force transmission element, in this case via a Bowden cable 5, to an exterior door handle 17 that is only indicated in FIG. 1. In this way, the pawl 2 can be raised via actuation of the exterior door handle 17, as long as the lock state, yet to be explained, of the motor vehicle lock allows this.

Arranged between the actuating lever 4 and the pawl 2 is a switchable clutch arrangement 6. This means that the clutch arrangement 6 is located between the actuating lever 4 and pawl 2 in the drive train. In the engaged state (FIGS. 2 and 3), the clutch arrangement 6 in this case establishes a drive connection between the actuating lever 4 and the pawl 2. In the disengaged state (FIGS. 1 and 4 to 6), the clutch arrangement 6 severs the drive connection between the actuating lever 4 and the pawl 2.

Specifically, the clutch arrangement 6 is located in terms of drive between the actuating lever 4 and the pawl lever 7, which in turn acts on the pawl 2. The pawl 2 is thus raised via the actuating lever 4 and the pawl lever 7.

The clutch arrangement 6 is equipped with an adjustable clutch element **6*a* which is configured, in a manner yet to be explained, as a wire that is bendable in a spring-elastic manner. The clutch element 6*a* is assigned two parallel, pawl-lever-side control edges 8 on one side and an actuating-lever-side control edge 9** on the other side.

In the engagement region, the control edges 8, 9 are oriented substantially perpendicularly to the extension of the wire-like clutch element **6*a*. The force transmitted in each case is oriented substantially perpendicularly to the extension of the wire-like clutch element 6*a***.

The clutch element **6*a* can now be brought into a disengagement position (FIG. 1) in which it is in each case disengaged from the actuating-lever-side control edge 9 so that when actuated, in the anticlockwise direction in the drawing, the actuating lever 4 would in principle execute an idle stroke, provided that the clutch element 6***a* would remain in its disengagement position.

The clutch element 6*a* can furthermore be adjusted into an engagement position (FIG. 2) in which it is engaged or can be brought into engagement both with the pawl-lever-side control edges 8 and with the actuating-lever-side control edge 9. The clutch element 6*a* in this case establishes a drive connection between the actuating lever 4 and the pawl lever 7 and thus to the pawl 2. Actuation of the actuating lever 4 results in the pawl 2 being raised, as is shown in FIG. 3.

An adjustment of the clutch element 6*a* between the disengagement position (FIG. 1) and the engagement position (FIG. 2) corresponds in the drawing to an adjustment between the lower position and the upper position of the clutch element 6*a*.

Figure 2:
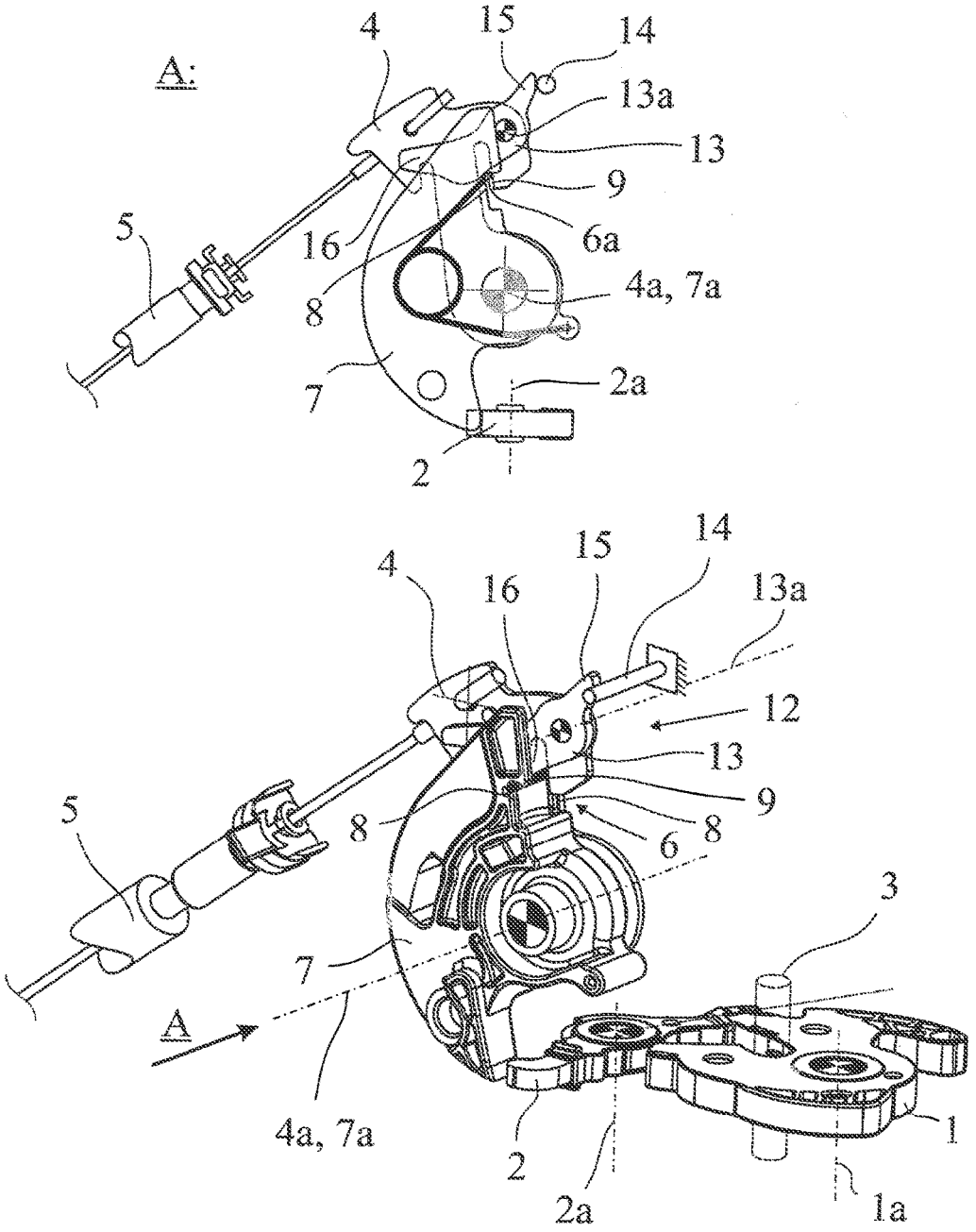
FIG. 2 shows the arrangement according to FIG. 1 during normal operation with the actuating lever semi-actuated, FIG. 3 chose the arrangement according to FIG. 1 during normal operation with the actuating lever fully actuated.
Figure 3:
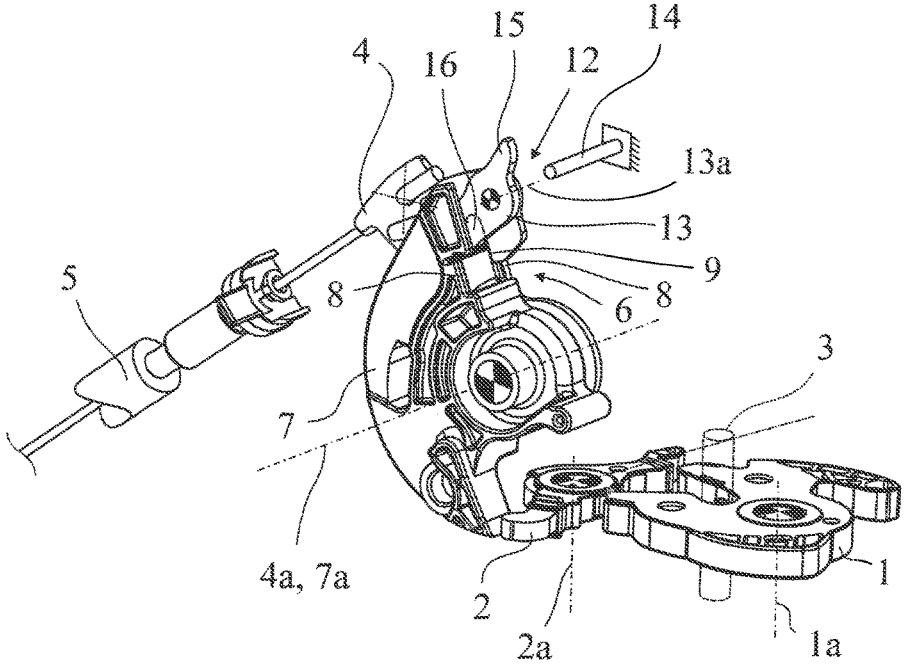

According to the proposal, the actuating lever 4 interacts with the clutch arrangement 6 such that, when adjusted into its unactuated state (FIG. 1), the actuating lever 4 disengages the possibly engaged clutch arrangement 6 and leaves the possibly disengaged clutch arrangement 6 in the disengaged state and, during its unactuated state, bars engagement of the clutch arrangement 6 and enables this only in the course of its actuation (FIGS. 2 and 3). The manner in which this proceeds will be explained further below.

What is essential first of all is that an adjustment of the actuating lever 4 into its unactuated state (FIG. 1) always ends with the clutch arrangement 6 disengaged. Here, such an adjustment of the actuating lever 4 into its unactuated state is the returning of the actuating lever 4 in the clockwise direction following an actuation, discussed above, of the actuating lever 4 in the anticlockwise direction. In this case, depending on the lock state to be explained, the clutch arrangement 6 may already have been disengaged or only be disengaged by the adjustment of the actuating lever 4 into its unactuated state.

What is essential furthermore is that, in its unactuated state, shown in FIG. 1, the actuating lever 4 bars the engagement of the clutch arrangement 6, that is to say does not to this extent allow the adjustment of the clutch element 6*a* into the upper position in the drawing. Only in the course of the actuation of the actuating lever 4 is it possible for the clutch arrangement 6 to adjust the clutch element 6*a* into the upper position, that is to say into the engagement position.

The expression "bar the engagement of the clutch arrangement" should be understood broadly in the present case. It means quite generally that the engagement of the clutch arrangement 6 is prevented, wherein a force flow between the actuating lever 4 and the clutch element 6*a* does not have to be provided continuously. For example, it is also possible for the clutch element 6*a* to be retained temporarily in the disengagement position as part of a central locking function that is yet to be explained, such that, although engagement is still barred by the actuating lever 4, there is no force flow between the actuating lever 4 and the clutch element 6*a*. To this extent, a certain clearance may be provided between the actuating lever 4 and the clutch element 6*a* in the barred state.

Given a suitable design, it is the case that, in the course of the actuation of the actuating lever 4, the clutch arrangement 6 here is engageable in a spring-driven manner such that the pawl 2 is raisable during normal operation by continuing actuation of the actuating lever 4. A complete actuating stroke thus comprises first of all the engagement of the clutch arrangement 6 and subsequently the raising of the pawl 2, provided that the actuation of the actuating lever 4 takes place during normal operation, that is to say at a normal actuating speed. The expression "normal operation" is differentiated in the present case from operation in the event of a crash. Normal operation is distinguished in particular in that the actuation of the actuating lever takes place at a normal actuating speed which is usually based on manual user actuation.

On account of inertia, the engagement of the clutch arrangement 6 always takes place with a certain delay following release by the actuating lever 4. In this case, the inertia behaviour of the clutch element 6*a* and of the components involved in the adjustment of the clutch element 6*a* plays the essential role.

Figure 4:
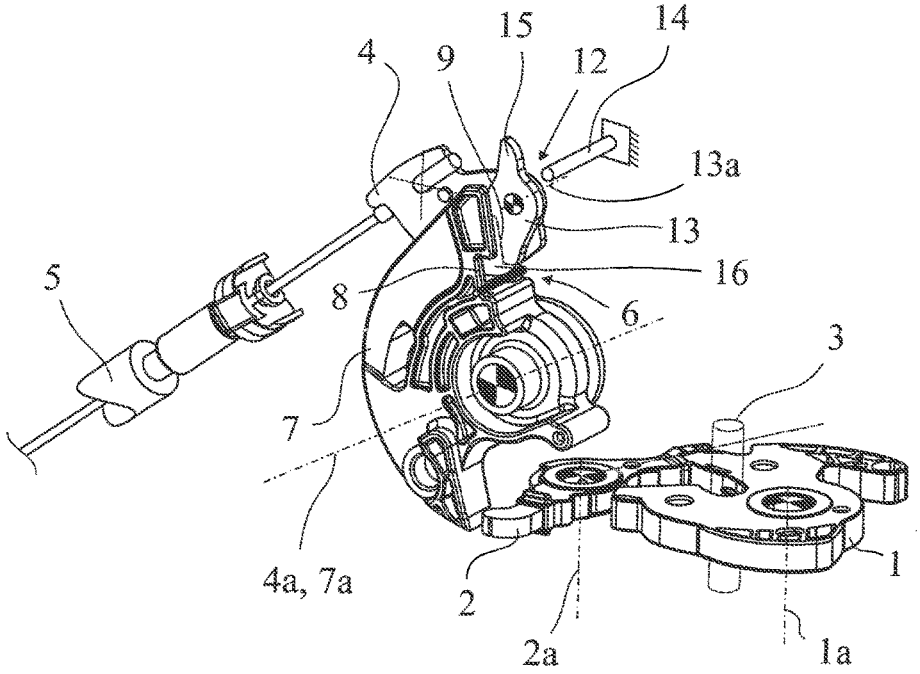
FIG. 4 shows the arrangement according to FIG. 1 in the event of a crash with the actuating lever actuated on account of the crash.

The delay on account of inertia during the engagement of the clutch arrangement 6 is used according to the proposal to convert a crash-related, undesired actuation of the actuating lever 4 into an idle stroke. Specifically, it is proposed that when the actuating lever 4 is actuated at an actuating speed which is above a predetermined limit speed, here as a result of crash accelerations that occur in the event of a crash, the actuating lever 4 executes an idle stroke on account of the engagement, here delayed as a result of inertia, of the clutch arrangement 6. This is illustrated in FIG. 4.

With the solution according to the proposal, particularly rapid actuating movements are thus always converted into an idle stroke. The design should be made such that the crash-related actuating movements that are statistically to be expected are affected thereby.

In the exemplary embodiment that is illustrated, the actuation of the actuating lever 4 comprises a releasing stroke which is associated with the releasing of the clutch arrangement 6 for engagement. The releasing stroke results from the transition from FIG. 1 to FIG. 2. Furthermore, the actuation of the actuating lever 4 comprises an activating stroke which, with the clutch arrangement—in the meantime—engaged, is associated with the raising of the pawl 2. The activating stroke results from the transition from FIG. 2 to FIG. 3. Here, the activating stroke immediately follows the releasing stroke.

The design of the releasing stroke, in particular the extent of the releasing stroke, has a particular meaning for the solution according to the proposal, provided that a crash-related actuation of the actuating lever 4 is intended to be converted into an idle stroke. Specifically, it can be the case that when the actuating lever 4 is actuated at an actuating speed which is above the predetermined limit speed, here as a result of crash accelerations that occur in the event of a crash, the time required for running through the releasing stroke is less than the time required, in particular on account of inertia, for engagement. Following completion of the releasing stroke, engagement of the coupling arrangement 6 is thus not complete, and so the pawl 2 is not raised during the activating stroke. The actuating lever 4 executes an idle stroke (FIG. 4).

In principle, the clutch arrangement 6 can be provided exclusively for increasing crash safety in the above sense. In a configuration, the clutch arrangement 6 is also used for setting lock states of the motor vehicle lock. To this end, the clutch arrangement 6 is a constituent part of a lock mechanism 10 which serves to set different lock states. The lock mechanism 10 can be brought into at least one locking state in which the clutch arrangement 6 is disengaged, and into at least one unlocking state in which the clutch arrangement 6 is engaged. The lock mechanism 10 can be brought into the respective states such as by motor, this corresponding in principle to a central locking function.

Figure 5:
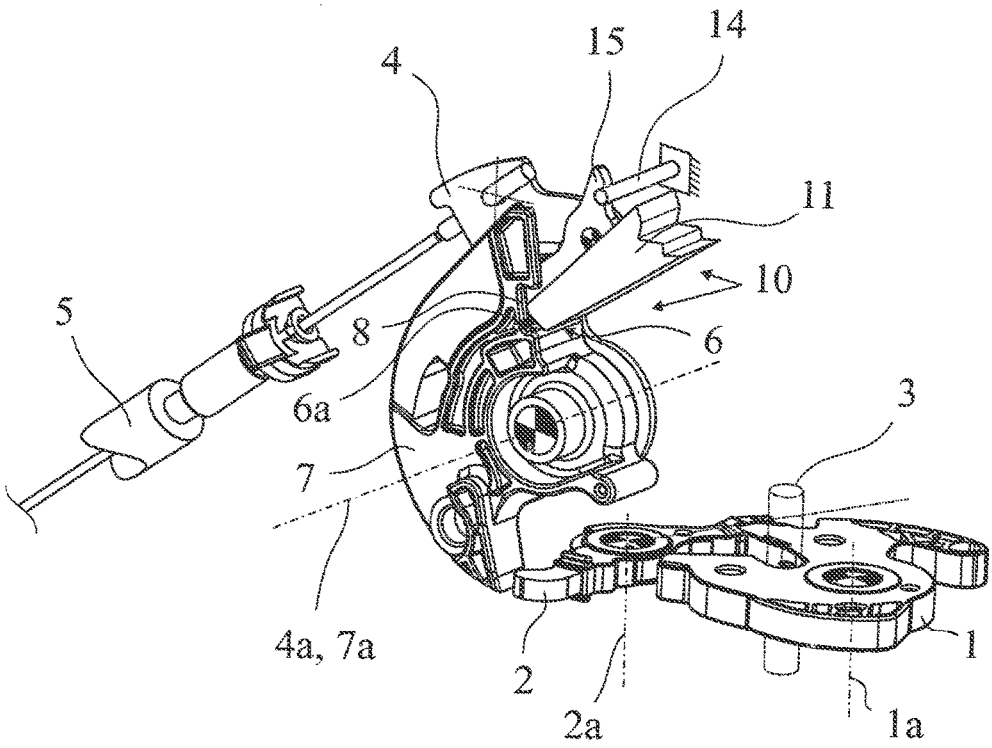
FIG. 5 shows the arrangement according to FIG. 1 during normal operation with a central locking lever located in the locking position.

The lock mechanism 10 can be equipped with a central locking lever 11, which is merely indicated in FIG. 5. The central locking lever 11 can be brought into the locking position illustrated in FIG. 5 and into an unlocking position (not illustrated), wherein the central locking lever 11 disengages the clutch arrangement 6 in its locking position. In its unlocking position (not illustrated), which, starting from the position shown in FIG. 5, corresponds to an upwardly pivoted position, the central locking lever 11 that can enable the engagement of the clutch arrangement 6.

What is interesting in the exemplary embodiment that is illustrated is the fact that the actuating lever 4 and the central locking lever in 11 act on the clutch arrangement 6 in the manner of a disjunction. As long as the actuating lever 4 is in its unactuated state or the central locking lever 11 is in its locking position, the clutch arrangement 6 is inevitably in its disengaged state.

In principle, it is conceivable for the actuating lever 4 to interact directly with the clutch element 6*a* in order to bar the engagement of the clutch arrangement 6. However, here it is the case that the actuating element 4 interacts with the clutch arrangement 6 via a transmission arrangement 12. In this case, provision is made to a configuration for the transmission arrangement 12 to be configured as a step-up arrangement such that a movement input on the actuating-lever side is converted into a larger movement output on the clutch-element side. As a result of a suitable design of the transmission arrangement 12, in particular the gear ratio of the transmission arrangement 12, the above-discussed design of the extent of the releasing stroke can be realized very precisely.

A particularly simple possibility for realizing the transmission arrangement 12 consists in equipping the transmission arrangement 12 with a pivotable transmission lever 13 such that the actuating lever 4 is coupled to the clutch arrangement 6, in this case to the clutch element 6*a*, via the pivotable transmission lever 13. The transmission lever 13 can in principle be articulated in a stationary manner in a fixed position. Here, the transmission lever 13 is, however, articulated on the actuating lever 4 in a pivotable manner about a transmission lever axis 13*a*.

In some embodiments, provision is made of a stop 14 with which the transmission lever 13 comes into engagement when the actuating lever 4 is adjusted into its unactuated state, and in the process disengages the clutch arrangement 6 and bars engagement of the clutch arrangement 6. This results from the transition from FIG. 2 to FIG. 1. In this case, a first lever arm 15 comes into engagement with the stop 14 (FIG. 2), this resulting in the transmission lever 13 pivoting about its axis 13*a* in the anticlockwise direction in FIG. 2. At the same time, a second lever arm 16 pushes the transmission lever 13 of the clutch element 6*a* downwards in FIG. 2, that is to say into the disengaging position, such that, when the position illustrated in FIG. 1 is reached, engagement of the clutch arrangement 6 via the transmission lever 13 is barred.

Here, with the actuating lever 4 unactuated, the effective stop-side lever arm 15 is shorter than the effective clutch-side lever arm 16. In this way, the above-discussed advantageous gear ratio of the transmission arrangement 12 can be set easily.

In the exemplary embodiment that is illustrated, the two lever arms 15, 16 extend in different directions from the transmission lever axis 13*a*. FIG. 1 shows that the two lever arms 15, 16 even extend in substantially opposite directions from the transmission lever axis 13*a*.

Figure 6:
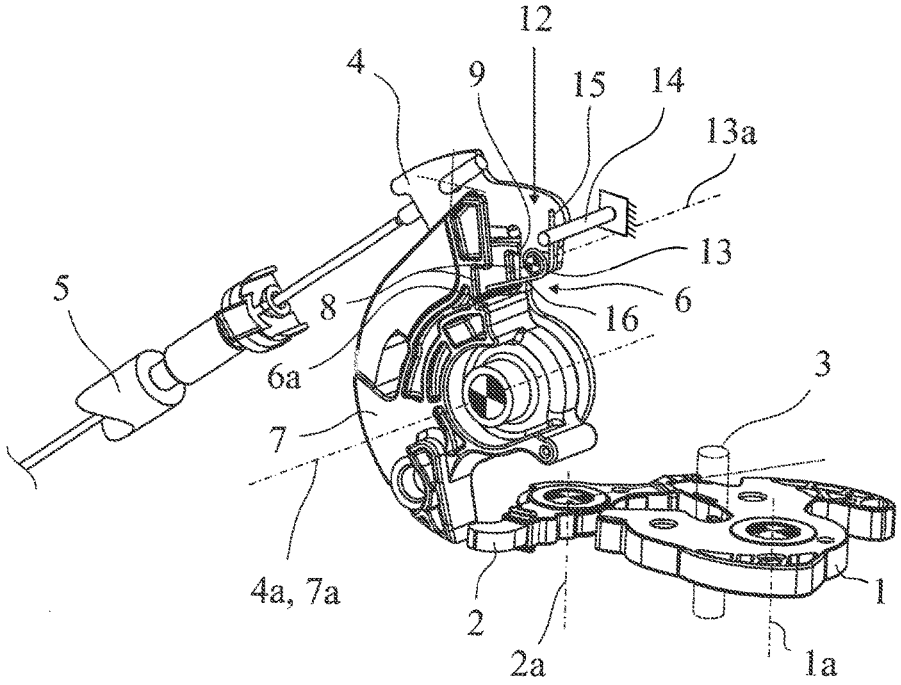
FIG. 6 shows the components, essential for the solution according to the proposal, of a further motor vehicle lock arrangement according to the proposal during normal operation with the actuating lever unactuated.

The transmission lever 13 may be a simple plastics or sheet-metal part. A variant that is producible in a particularly cost-effective manner is shown in the illustration according to FIG. 6, in which the transmission lever 13 is formed from a wire or strip that is bendable in a spring-elastic manner. In a configuration, the transmission lever 13 is configured in the manner of a leg spring, wherein the one spring leg provides the stop-side lever arm 15 and the other spring leg provides the clutch-side lever arm 16. The spring coils of the leg springs provide, as shown in FIG. 6, the pivot axis 13*a* of the transmission lever 13 on the actuating lever 4.

It has already been explained that the clutch arrangement 6 has an adjustable clutch element 6*a* which is adjustable into an engagement position corresponding to the engaged state and into a disengagement position corresponding to the disengaged state. The clutch element 6*a* here is a wire or strip that is bendable in a spring-elastic manner and is bendable between the engagement position and the disengagement position. In this case, the fact that the clutch element 6*a* can be prestressed into the engagement position by its own spring elasticity is particularly advantageous. As a result, the above-discussed spring-driven engagement of the clutch arrangement 6 can be achieved in a very particularly simple manner.

In the following text, the mode of operation of the motor vehicle lock according to the proposal is summarized: when the central locking lever 11 is in the unlocking position, actuation of the actuating lever 4 out of the position shown in FIG. 1 has the effect that the clutch element 6*a* pushes upwards in the drawing as a result of its spring elasticity and pivots the transmission lever 13 in the clockwise direction about its transmission lever axis 13*a*. Since the actuation takes place here at a normal actuating speed, the clutch element 6*a* comes into the movement region of the actuating-lever-side control edge 9 before the actuating-lever-side control edge 9 passes the clutch element 6*a*. As a result, as shown in FIG. 3, the clutch element 6*a* is carried along by the actuating-lever-side control edge 9, acts on the pawl-lever-side control edge 8 and causes the pawl lever 7 to pivot in the anticlockwise direction in FIG. 3 and thus causes the pawl 2 to be raised.

However, if the actuation of the actuating lever 4 is as the result of a crash, this is generally an actuation at a particularly high actuating speed. Given a suitable design, the actuating-lever-side control edge 9 passes the clutch element 6*a* before the clutch element 6*a* has reached the engagement position. Correspondingly, no drive connection between the actuating lever 4 and the pawl lever 7 occurs, and so, as illustrated in FIG. 4, the actuating lever 4 executes an idle stroke.

It should also be mentioned that in the event that the central locking lever 11 is in the locking position illustrated in FIG. 5, the above-described mechanism according to the proposal does not apply. The reason for this is that the central locking lever 11 is already retaining the clutch element 6*a* in the disengagement position, and so the actuating lever 4 executes an idle stroke in any case.

It may also be noted that the arrangement according to the proposal is particularly compact. In this case, the fact that the pawl lever 7 is pivotable about a pawl axis 7*a* which is oriented concentrically with the actuating lever axis 4*a* of the actuating lever 4 should be highlighted. The clutch element 6*a* can be a constituent part of a leg spring, the spring coils of which here are oriented parallel to the actuating lever axis 4*a*. The lock latch axis 1*a* and the pawl axis 2*a* are parallel to one another but oriented perpendicularly to the actuating lever axis 4*a*. The pivot axis (not illustrated) of the central locking lever 11 here is oriented parallel to the actuating axis 4*a*. This results overall in an arrangement in which in particular the actuating lever 4 and the pawl lever 7 can be nested in one another in a space-saving manner.

Finally it may also be noted that, in the exemplary embodiment that is illustrated, the actuating lever 4, as discussed above, is an external actuating lever of the motor vehicle lock, which is actuable via an exterior door handle 17.

However, it is also conceivable for provision to be made of a door handle 17, in particular an exterior door handle 17, and for in any case the actuating lever 4, and in some embodiments also the clutch arrangement 6, to be a constituent part or parts of the door handle 17 and/or to be accommodated in the door handle 17. In an embodiment, the door handle 17 is then a constituent part of a handhold of the door handle 17 or the handhold itself. The door handle 17, in particular the actuating lever 4 via the clutch arrangement 6, can then be coupled to the motor vehicle lock by means of a Bowden cable or the like, and is coupled to the pawl 2 in terms of drive there or can be coupled thereto via an optionally provided lock mechanism. All of the above explanations apply in a corresponding manner for such a configuration. Such a door handle 17, which has both the actuating lever 4 and the clutch arrangement 6, is the subject matter of a further, independent teaching.

According to a further teaching, the motor vehicle lock of the motor vehicle lock arrangement is described as such. Reference may be made to all of the statements with respect to the motor vehicle lock arrangement which are suitable for describing the motor vehicle lock as such. In particular, all of the explained variants of the motor vehicle lock arrangement according to the proposal, provided that they relate to the motor vehicle lock, are applicable to the further teaching in a corresponding manner.

The invention claimed is:

1. A motor vehicle lock arrangement comprising a motor vehicle lock, the motor vehicle lock comprising a lock latch, a pawl, an actuating lever for raising the pawl, and a switchable clutch arrangement arranged between the actuating lever and the pawl;

wherein the lock latch is adjustable into an open position, into a main locked position, and optionally into a pre-locked position;

wherein the pawl is adjustable into a lowered position in which the pawl retains the lock latch in the main locked position, and into a raised position in which the pawl is disengaged from the lock latch;

wherein the switchable clutch arrangement comprises an engaged state that enables a drive connection between the actuating lever and the pawl, and a disengaged state that severs the drive connection between the actuating lever and the pawl;

wherein the actuating lever comprises an unactuated state;

wherein, with the clutch arrangement in the engaged state, adjustment of the actuating lever into the unactuated state disengages the clutch arrangement;

wherein, with the clutch arrangement in the disengaged state, adjustment of the actuating lever into the unactuated state leaves the clutch arrangement in the disengaged state;

wherein the actuating lever in the unactuated state bars engagement of the clutch arrangement; and wherein the actuating lever enables engagement of the clutch arrangement only in the course of actuation of the actuating lever out of the unactuated state.

2. The motor vehicle lock arrangement according to claim 1, wherein, in the course of the actuation of the actuating lever, the clutch arrangement is engageable, such that the pawl is raisable during normal operation.

3. The motor vehicle lock arrangement according to claim 1, wherein actuation of the actuating lever at an actuating speed which is greater than a predetermined limit speed results in the actuating lever executing an idle stroke on account of delayed engagement of the clutch arrangement.

4. The motor vehicle lock arrangement according claim 1, wherein the actuation of the actuating lever comprises a releasing stroke which is associated with enabling engagement of the clutch arrangement, and an activating stroke which is associated, with the clutch arrangement in the engaged state, with raising of the pawl.

5. The motor vehicle lock according to claim 4, wherein when the actuating lever is actuated at an actuating speed which is greater than a predetermined limit speed, a time required to execute the releasing stroke is less than a time required for engagement of the clutch arrangement, resulting in the actuating lever executing an idle stroke.

6. The motor vehicle lock arrangement according to claim 4, wherein the activating stoke immediately follows the releasing stroke.

7. The motor vehicle lock arrangement according claim 1, wherein the clutch arrangement is a constituent part of a lock mechanism which can be brought into at least one locking state in which the clutch arrangement is disengaged, and at least one unlocking state in which the clutch arrangement is engaged.

8. The motor vehicle lock arrangement according claim 7, wherein the lock mechanism comprises a central locking lever which can be brought into a locking position and into an unlocking position;

wherein, in the locking position, the central locking lever disengages the clutch arrangement; and wherein, in the unlocking position, the central locking lever enables engagement of the clutch arrangement.

9. The motor vehicle lock arrangement according to claim 1, wherein the actuating lever interacts with the clutch arrangement via a transmission arrangement.

10. The motor vehicle lock arrangement according to claim 9, wherein the transmission arrangement is configured as a step-up arrangement such that a movement input on an actuating-lever side of the transmission arrangement is converted into a larger output movement.

11. The motor vehicle lock arrangement according to claim 1, wherein the actuating lever is coupled to the clutch arrangement via a pivotable transmission lever.

12. The motor vehicle lock arrangement according claim 11, further comprising a stop with which the transmission lever comes into engagement when the actuating lever is adjusted into its unactuated state, thereby disengaging the clutch arrangement and barring engagement of the clutch arrangement.

13. The motor vehicle lock arrangement according to claim 11, wherein the transmission lever comprises a stop-side lever arm and a, clutch-side lever arm.

14. The motor vehicle lock arrangement according to claim 11, wherein the transmission lever is formed from a wire or strip that is bendable in a spring-elastic manner.

15. The motor vehicle lock arrangement according to claim 11, wherein the transmission lever is articulated in a pivotable manner on the actuating lever.

16. The motor vehicle lock arrangement according to claim 1, wherein the clutch arrangement comprises an adjustable clutch element which is adjustable into an engagement position corresponding to the engaged state and into a disengagement position corresponding to the disengaged state.

17. The motor vehicle lock arrangement according to claim 16, wherein the clutch element is configured as a wire or strip that is bendable in a spring-elastic manner and is bendable between the engagement position and the disengagement position.

18. The motor vehicle lock arrangement according to claim 1, further comprising a door handle, wherein the actuating lever is a constituent part of the door handle and/or is accommodated in the door handle.

19. A motor vehicle lock comprising a lock latch, a pawl, an actuating lever for raising the pawl, and a switchable clutch arrangement arranged between the actuating lever and the pawl;

wherein the lock latch is adjustable into an open position, into a main locked position, and optionally into a pre-locked position;

wherein the pawl is adjustable into a lowered position in which the pawl retains the lock latch in a locked position, and into a raised position in which the pawl is disengaged from the lock latch;

wherein the switchable clutch arrangement comprises an engaged state that enables a drive connection between the actuating lever and the pawl, and a disengaged state that severs the drive connection between the actuating lever and the pawl;

wherein the actuating lever comprises an unactuated state;

wherein, with the clutch arrangement in the engaged state, adjustment of the actuating lever into the unactuated state disengages the clutch arrangement;

wherein, with the clutch arrangement in the disengaged state, adjustment of the actuating lever into the unactuated state leaves the clutch arrangement in the disengaged state;

wherein the actuating lever in the unactuated state bars engagement of the clutch arrangement; and wherein the actuating lever enables engagement of the clutch arrangement only in the course of actuation of the actuating lever out of the unactuated state.

20. A door handle for raising a pawl of a motor vehicle lock, wherein the motor vehicle lock comprises the pawl and a lock latch, and the door handle comprises an actuating lever for raising the pawl and a switchable clutch arrangement arranged between the actuating lever and the pawl;

wherein the lock latch is adjustable into an open position, into a main locked position, and optionally into a pre-locked position;

wherein the pawl is adjustable into a lowered position in which the pawl retains the lock latch in a locked position, and into a raised position in which the pawl is disengaged from the lock latch;

wherein the switchable clutch arrangement comprises an engaged state that enables a drive connection between the actuating lever and the pawl, and a disengaged state that severs the drive connection between the actuating lever and the pawl;

wherein the actuating lever comprises an unactuated state;

wherein, with the clutch arrangement in the engaged state, adjustment of the actuating lever into the unactuated state disengages the clutch arrangement;

wherein, with the clutch arrangement in the disengaged state, adjustment of the actuating lever into the unactuated state leaves the clutch arrangement in the disengaged state;

wherein the actuating lever in the unactuated state bars engagement of the clutch arrangement; and wherein the actuating lever enables engagement of the clutch arrangement only in the course of actuation of the actuating lever out of the unactuated state.

* * * * *